United States Patent [19]

Marino

[11] 4,070,854

[45] Jan. 31, 1978

[54] APPARATUS FOR REMOVING BOTTLE CAPS

[75] Inventor: Otto M. Marino, London, Canada

[73] Assignee: Labatt Breweries of Canada Limited, London, Canada

[21] Appl. No.: 726,821

[22] Filed: Sept. 27, 1976

[30] Foreign Application Priority Data

Oct. 17, 1975 Canada ..... 237884

[51] Int. Cl.[2] ..... B67B 7/16

[52] U.S. Cl. ..... 53/381 A; 81/3.2

[58] Field of Search ..... 53/381 A; 81/3.2; 214/304

[56] References Cited

U.S. PATENT DOCUMENTS 3,237,289 3/1966 Pearson et al. ..... 53/381 A X

FOREIGN PATENT DOCUMENTS 2,413,037 10/1975 Germany ..... 53/381 A

*Primary Examiner*—Travis S. McGehee

[57] ABSTRACT

A novel apparatus is described for decapping filled bottles sealed with a crown cap. The apparatus includes a means for conveying bottles to a decapping station. Said station comprises a movable presser means, adapted to press smoothly down on the dome of the cap, and an edge means arranged to engage under the lower rim of said cap. The edge means engages the lower extremity of the skirt of the cap in such a manner that the associated bottle is separated from the conveyor means and subsequent to the action of the presser means, preferably a chisel-shaped member, on the dome of the cap, the bottle is able to move downward and resume its upright position on the conveyor means, whereby the cap is completely loosened but remains positioned on the mouth of the bottle. The bottle is then conveyed to a station including means for the removal and controlled disposal of the loosened cap.

6 Claims, 10 Drawing Figures

20
22
54
86
88
90
92
94
96
30
100
102
104
106
108
26
28
32
64
58
56
72
62
66
70
118
53
3
3
10
11
134
132
136
112
114
116
124
172
162
120
128
126
119
114'
112'
29
138

APPARATUS FOR REMOVING BOTTLE CAPS

The present invention relates to the decapping of filled bottles sealed each with a crown cap.

BACKGROUND OF THE INVENTION

There are many instances when it is necessary to empty a number of bottles sealed with a crown cap. For example, it may well be that a large number of bottles containing defective liquid are returned to the manufacturer and the bottles are required for reuse. An alternative situation which more often arises, is in the use of automatic bottling lines. If an operation on such a line is defective, for example, the volume of liquid introduced into each bottle is incorrect, due to the high speed operation of such lines the number of bottles filled and sealed before the situation is detected may run into hundreds, all of which upon detection will have to be emptied and returned for refilling. Moreover, the same problem arises if, for example, the bottle label is incorrectly or so badly applied, subsequent to being filled, that the product is considered commercially unpresentable. Originally, such bottles had to be decapped and emptied by hand which was obviously a tedious and time consuming operation.

Attempts have been made therefore to provide means for decapping and emptying such bottles automatically. For example, British patent specification No. 1,316,252 teaches an apparatus for opening and emptying filled bottles sealed with a crown cap. The apparatus is complex and includes a decapping station wherein the bottle is supported in a horizontal position and plunger means are arranged to strike the cap thrusting the bottle rearwards whilst the cap is retained at that station: the bottle then falls under gravity in an inverted position whereupon the liquid inside the bottle is discharged. As mentioned previously the apparatus required is relatively complex requiring means to locate the bottle in the horizontal position and subsequently receive the bottle in its decapped state. More importantly, the shock on the bottle due to the action of the plunger is obviously quite severe. An alternative apparatus presently available comprises a horizontal conveyor for delivering the capped, filled, bottles to a decapping station. At the decapping station, there is provided a wheel rotating in a vertical plane containing the conveyor, said wheel being provided with two types of tools: a metal peg arranged to crease and deform the cap and a hook arranged to follow the peg, grip the underlying edge of the crown cap and rip or yank the cap off the bottle due to the opposite relative motion of the hook and the bottle. Obviously, the bottle must be restrained whilst the cap, which is still affixed to the bottle neck, is being ripped off and this is effected by way of star wheels located to a side of the decapping zone. The decapped bottle is then emptied in some manner. Again, a disadvantage of this apparatus is the violent way in which the crown cap is removed and this results in many cases in the sealing ring on the bottle mouth being chipped. Major problems arise when the chipping is not excessive since in such cases it is generally not detected and the bottle may be recycled resulting in damage to the automatic filling equipment, such as sealing washers etc. being ripped or torn by the chipped bottle neck. This further augments the original problem since damage to the seal on the bottling equipment causes further inaccuracy in bottle filling and produces more defectively filled bottles. An additional disadvantage of this equipment is that the crown caps are not removed in a consistent or controlled manner and their orderly collection is therefore difficult, if not impossible. Indeed, it has been found that many freed caps merely fall onto the conveyor belt and associated equipment causing foul-ups.

It is an object of the present invention to provide a decapping apparatus which may rapidly, and in a non-violent, controlled manner remove crown caps from filled bottles.

STATEMENT OF INVENTION

According to the present invention there is provided an apparatus for the decapping of filled bottles sealed with a crown cap, said apparatus comprising a decapping station; conveyor means for transporting vertically oriented filled bottles sealed with a crown cap, having a dome and skirt, to said station, means defining at least one edge engageable under the lower extremity of the skirt so as to be able to support the associated bottle whilst the bottle is travelling through said station; presser means at the station arranged to move in the direction of, and synchronous with, bottle travel and to press down smoothly on each crown cap dome whilst the bottle is supported by said edge means, whereby the presser means and edge means combine to deform the cap in such a manner that the skirt portion thereof disengages the bottle neck; and means adapted to controllably remove the freed cap overlying the bottle mouth.

The conveyor means is typically a belt conveyor system which transports the bottles in an upright position to the decapping station.

The decapping station includes edge means which is aligned in such a manner that, when said edge means engages under the lower rim of the skirt of the crown cap, the associated bottle is at least partially separated from the conveyor means during the action of the presser means so that the bottle is able to move downwards out of the cap.

The edge means is conveniently spring-biased to allow for variances in alignment of the bottles on the conveyor means. Additionally, the position of the edge means may be adjustable in order to accommodate bottles of various heights and cap sizes.

The positive action of the presser means is synchronized with the movement of the bottles such that upon the bottle being at least partially separated from the conveyor via the edge means, the presser means presses down smoothly on the crown cap while moving in the same direction, and with substantially the same speed, as the bottle. The simultaneous downward and forward movement of the presser means allows the bottle to be smoothly pressed loose from the cap and to regain its upright orientation on the conveyor means without being impeded, the freed cap at this stage merely overlying the bottle mouth.

Additionally, since there is no relative movement between the presser means and the cap, there is no tendency for the cap to be ripped or scratched, a fault prevalent in prior art devices. Scarf produced in this manner is highly undesirable since it tends to enter the machinery and cause foul-ups.

The presser means may comprise a driven cam member which in operation rotates in a vertical plane in the direction of travel of the bottles in such a manner that the crest of the cam presses smoothly down on the dome of the crown cap to effect the desired response. Alternatively, the presser means may comprise a motor driven wheel rotating in a vertical plane and in the direction of the bottle travel, said wheel being equipped with suitable protuberances arranged to press down on the dome of each cap to effect its disengagement from the associated bottle neck as before. Preferably, the presser means comprises a chisel-shaped member connected by clamp means to a camshaft whose motion is adapted to impart to the presser means a roughly circular or elliptical periodic motion in a vertical plane. The presser member movement represented by the lower limb of the ellipse is in the direction of bottle travel and it is during that movement that the presser member acts against each cap to deform same and cause disengagement thereof from the associated bottle neck.

It should be emphasized that after passage through the decapper station, each crown cap skirt is totally disengaged from the bottle neck, although at this stage, the caps are generally left astride the associated bottle mouths and are thereby carried out of the decapping station by the bottle.

The presser means may be adjusted to contact the crown cap along the centre-line of said cap, but preferably at some point laterally off-centre.

In the immediately following description the general features and operation of the novel decapper device will be described with reference to the accompanying drawings in which:

FIG. 1 is a diagrammatic perspective view of the apparatus of the present invention;

FIG. 2*a* is an enlarged perspective view of a portion of the chain loop provided with longitudinally spaced projections shown in FIG. 1;

Figure 1:
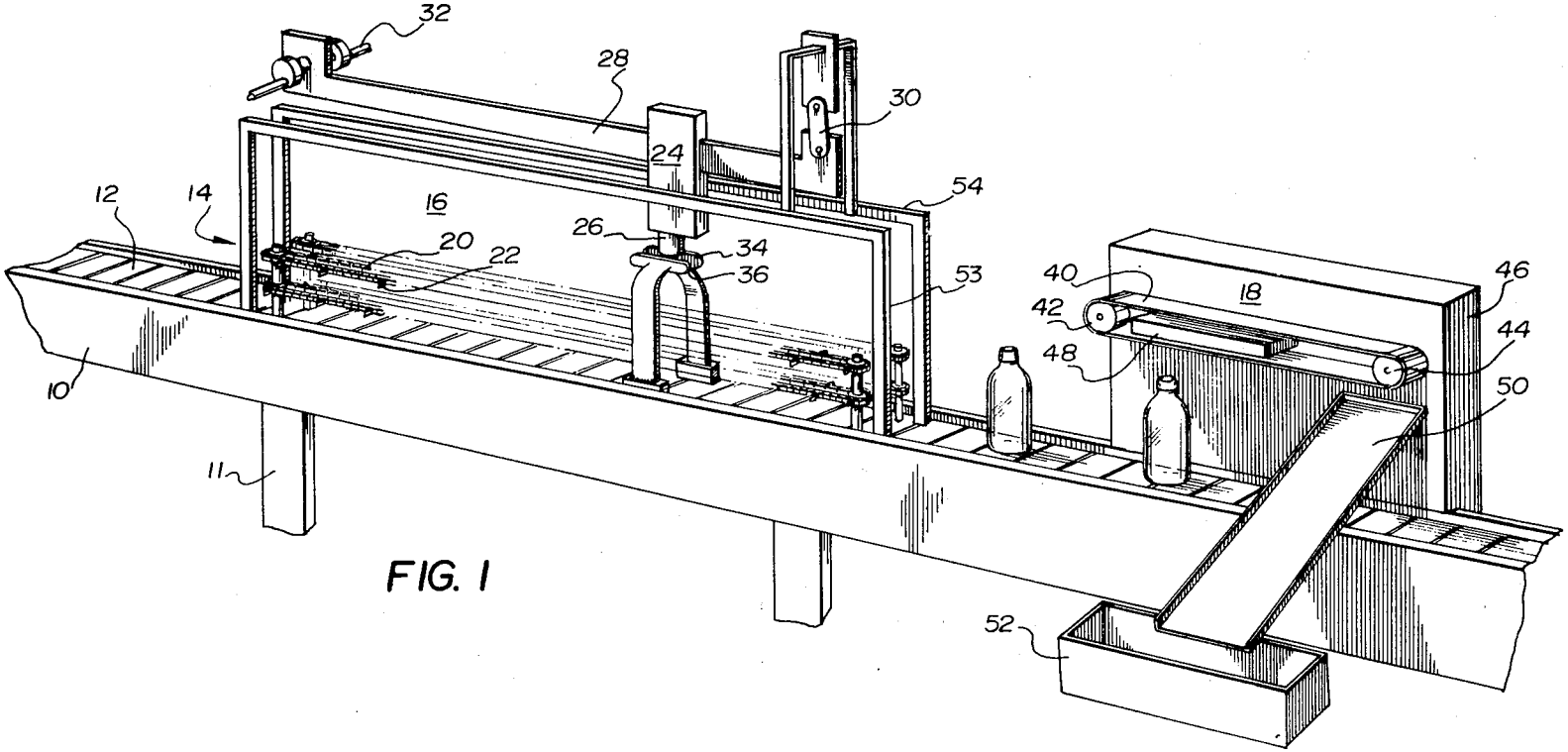

With reference to FIG. 1, the device comprises a base plate 10 upon which is located a plate conveyor 12 which forms the base of a bottle pathway generally designated 14. The conveyor 12 serves to transport filled sealed bottles to and from the decapping device, which comprises two zones, a cap disengaging or loosening zone 16 and a freed-cap removing zone 18. Located within zone 16 are two vertically stacked horizontally located chain loops 20 situated adjacent a side of the bottle travel path 14, the base of which is, as stated above, constituted by horizontally located plate conveyor 12. Each chain loop 20 is provided with a plurality of longitudinally spaced projections 22 which extend a short distance laterally across the bottle pathway 14. In this arrangement, the projections 22 on opposing chain loops act in combination to provide a series of loose pockets for the bottles travelling along pathway 14. Moreover, when necessary, projections 22 located immediately upstream of a bottle travelling on the pathway are able to contact the bottle and urge same along the pathway when the force imparted by conveyor 12 may not be sufficient, i.e. at the cap disengaging station 16 (see below).

The cap disengaging station 16, which will be described in detail with reference to FIGS. 2 to 5, comprises a presser member 24, the pressing tool 26 thereof being adapted to move in an elliptical path contained in a vertical plane including the bottle pathway 14 by an arrangement involving a camrod 28, pivot link 30 and camshaft 32. Pusher member 24 acts in combination with edge means or member 36 and member 34 which is biased so as to maintain member 34 in contact with the cap which is thereby urged onto edge member 36. Edge member 36 provides a ledge which can engage under the skirt of a bottle travelling along pathway 14. Moreover, the longitudinal axis of member 36 is inclined at an angle to the plate conveyor 12 so as to provide an incline upon which the cap engaged thereon must ride. Obviously, since the cap is still connected to the bottle, raising the cap in this fashion raises the bottle at least partially off conveyor 12. Whilst the bottle is being raised in the previously described manner presser member 24 is then transcribing the lower limb of its prescribed path and moving in the same direction and substantially at the same speed as the bottle. Moreover, whilst traversing that limb of the ellipse it is also arranged to be in contact with the dome of the cap and to be pressing the bottle thereout while the cap is restrained by edge member 36. The smooth force applied longitudinally down the bottle causes the cap skirt to be deformed thereby disengaging same from the sealing rim on the bottle. However, the cap is not removed from the bottle but merely lies astride the bottle in its deformed disengaged condition as the bottle exits the disengaging zone. It will be appreciated that upon being raised at least partially from conveyor 12 the longitudinal force exerted by the chain loop projections 22 forces the bottle through the decapping station. The bottle carrying the freed cap then continues along pathway 14 carried once again by conveyor 12 to cap-removing zone 18 shown in FIG. 6. This zone comprises an endless belt 40 carried by rollers 42 and 44 at least one of which is driven. The rollers are carried by frame 46. Situated between the runs of the conveyor 40 is a magnet 48 which is able to act downward through the lower run of the conveyor. As a bottle passes underneath the lower run of the conveyor the magnet attracts the freed cap, the force of the magnet being sufficient to cause the cap to leave the bottle and become affixed to the under surface of the lower run of the endless belt 40. The length of the magnet is chosen so that its influence extends over a major portion of the endless belt but is absent at the downstream extremity thereof. The cap is therefore transported by the belt until the magnetic influence dissipates at which time the cap falls under the influence of gravity into chute 50 and finally rests in receptacle 52.

In operation therefore a bottle is transported through the decapping zone 16 via conveyor belt 12 to decapping station 16 where edge member 36 engages under the lower extremity of the skirt portion of the crown cap in such a manner that the bottle, urged by projections 22, is caused to lift at least partially from conveyor 12 by the inclined edge member 36. Whilst being solifted presser member 24 presses down on the cap dome so deforming the skirt so as to smoothly disengage the cap from the bottle. The bottle is gently returned automatically to the conveyor 12 with the freed cap overlying the bottle mouth thereof. The bottle and cap then proceed to cap-removing station 18 wherein the cap "jumps" off the bottle neck to become attached to the underneath of the lower flight of belt 40 and is conveyed thereby to chute 50 and finally becomes lodged in receptacle 52. The decapped bottle then proceeds along pathway 14 to a suitable emptying device or to an operator who empties same by hand.

Figures 2, 2A:
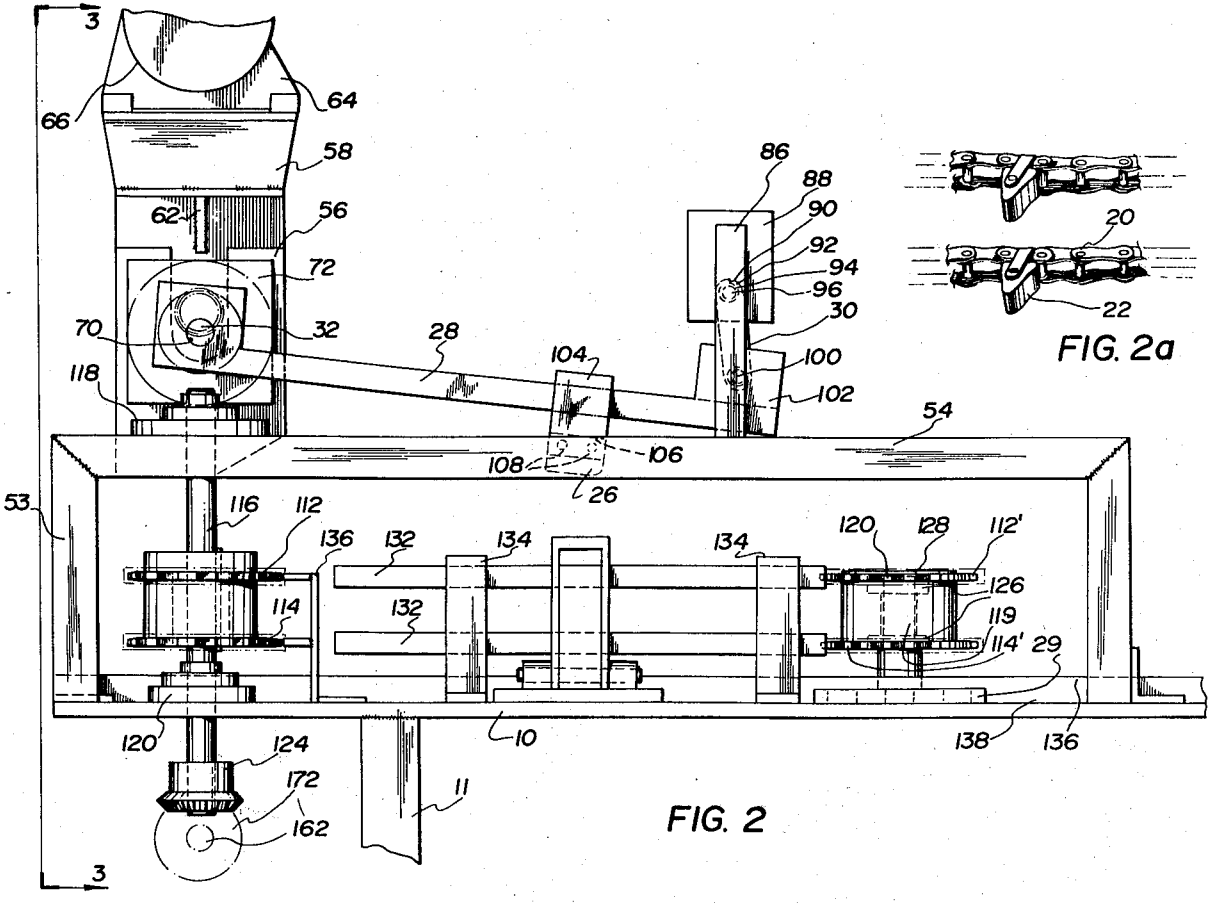
FIG. 2 is a side elevational view of the decapping station.
Figure 3:
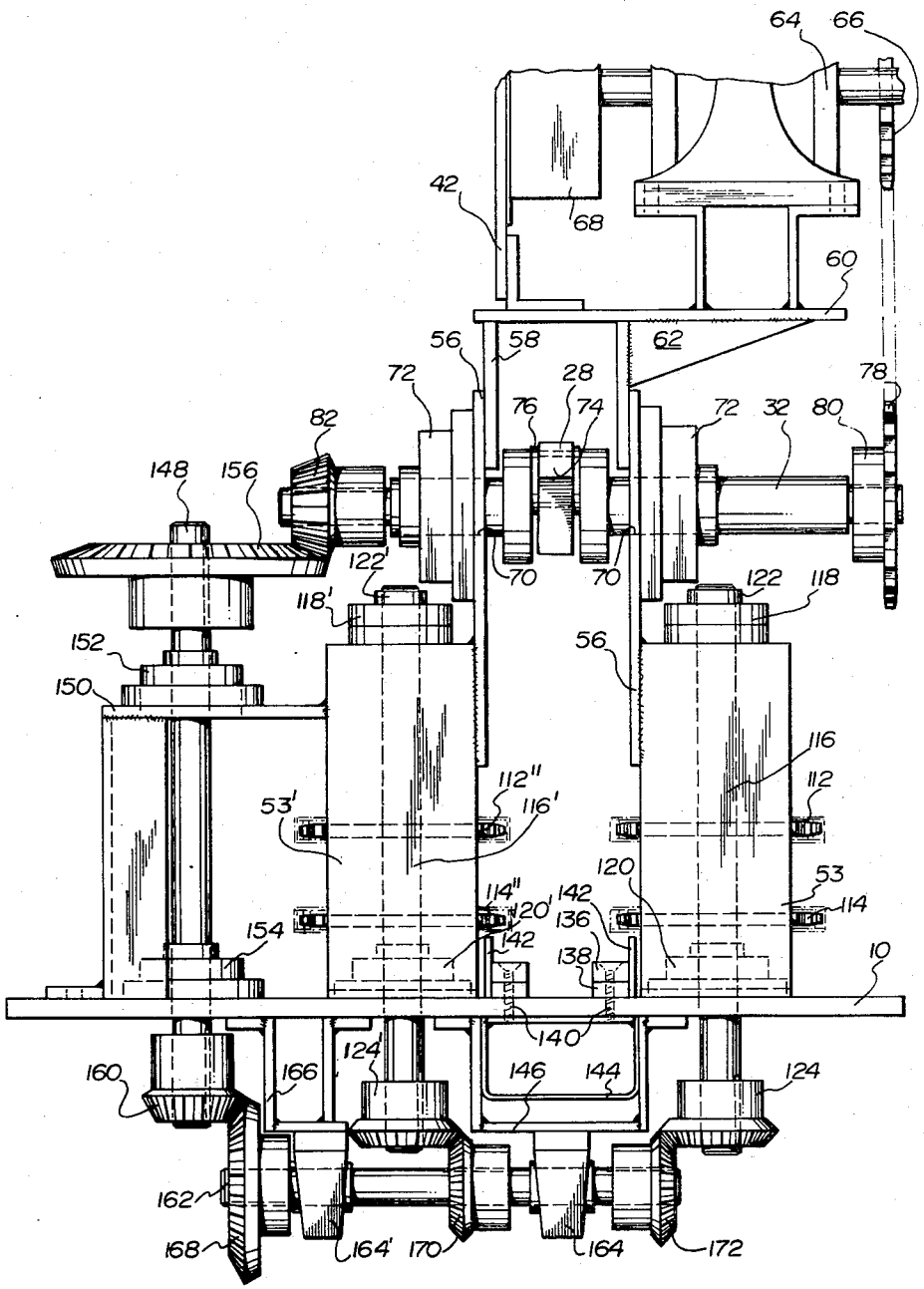
FIG. 3 is a cross-sectional view of the drive section of the decapping station shown in FIGS. 1 and 2.

Turning now to FIG. 2 and FIG. 3, these show a detailed side elevational view of the cap loosening zone 16 shown generally in FIG. 1 and a cross-sectional view of the drive section thereof respectively. Base plate 10 supported by legs 11 carries two supporting frames 53, only one of which is visible in this drawing. Frames 53 extend the full length of the cap loosening zone 16 and the upper limb 54 has welded thereto two opposing plate members 56 which themselves carry further plate extensions 58. The upper extremities of plates 58 provide the support means for platform 60, the rigidity of the arrangement being aided by support member 62. Mounted on platform 60 is an electric motor 64, the drive shaft of which carries a sprocket 66. The motor is provided with an air brake arrangement generally designated 68. Extending through each plate 56 is a bore hole 70. Associated with each bore hole 70 is a bearing 72, the bore holes 70 and bearings 72 being arranged to support crankshaft 32 in a horizontal position as shown. The centre portion 74 of the crankshaft 32 carries one extremity of camrod 28 via split bearing 76. One extremity of crankshaft 32 is provided with sprocket 78 and associated sprocket idler 80. Sprocket 78 is aligned vertically with sprocket 66 associated with motor 64. Affixed to the other extremity of crankshaft 32 is bevel gear assembly 82.

Bridging frame members 54 is an inverted U-shaped bracket 86 which carries a centrally located bracket 88 having located therethrough a bore 90 and associated collar 92 and bushing 94. A pin 96 extends through bracket 88 and carries two pivot link arms 30 (only one of which is visible). Arms 30 form part of the pivotal linkage by which the other extremity of camrod 28 is supported, arms 30 having apertures, collars etc. to allow pin 100 to secure said arms to bracket 102 constituting part of camrod 28.

Adjustably mounted on camrod 28 is holder 104, forming a part of presser member 24, which has a slot 106 extending therethrough parallel to camrod 28 and bottle pathway 14. Locked in slot 106 by way of screw members 108 is the presser tool 26.

The chain loop system comprises a pair of stacked endless chain loops located adjacent each side of the pathway 14. In FIGS. 2 and 3 the endless chain loops are omitted for clarity but a portion thereof is shown in detail in FIG. *2a*. Each endless chain loop is carried by a pair of sprockets, for example, 112 and 112' and 114 and 114'. There is, of course, a similar set of sprockets adjacent the opposing side of the pathway to those shown in FIG. 2 and one pair, namely, sprockets 112" and 114" is shown in FIG. 3. Sprockets 112 and 114 are carried by shaft 116 which is journaled in bearing 118 located atop frame member 54 and bearing 120 resting on base plate 10. Shaft 116 is maintained in position by way of collar 122 located at its upper extremity. The lower extremity of shaft 116 carries miter gear 124. Sprockets 112" and 114" are part of an exactly similar system and this description applies equally thereto. As will be seen later the said sprockets are driven via their associated shafts. Sprockets 112' and 114' respectively are idler sprockets located on shaft 119 via bearings 126, the uppermost sprockets 112' being protected by cover 128; the two sprockets being arranged to each carry one endless chain loop horizontally.

Located adjacent sprockets 112 and 114 is a bracket 136; the horizontal limbs of which are crescent shaped and extend around the periphery of part of sprockets 112 and 114. Guide members 132 are arranged to extend horizontally between sprockets 112 and 112', and 114 and 114' and are maintained in position by brackets 134 which themselves are affixed to plate 10.

Extending across the length of base plate 10 and forming the base for the plate conveyor (not shown) which forms the base of bottle pathway 14, are top rail 136 and bottom rail 138, these being pinned to the base plate by way of bolts 140. Adjacent the outer edge of rails 136 and 138 are guide rails 142. The lower run of the plate conveyor (not shown) is contained within guard member 144 which itself is contained within brackets 146.

In this embodiment the motor 64 is arranged to drive crankshaft 32 directly via sprocket 78 and to drive the two chain loop systems indirectly via bevel gear 82 and an associated gearing system. The gearing system comprises vertically located shaft 148 journaled in bracket 150 by way of bearing 152 and in base plate 10 by way of bearing 154. Shaft 148 at its upper end carries bevel gear 156 which is in engagement with bevel gear 82 on crankshaft 32 and at its lower end carries bevel bear 160. Located horizontally and traversely of bottle pathway 14 is a shaft 162 journaled in bearings 164 which bearings are carried by brackets 146 and 166 affixed to plate 10. Shaft 162 carries a bevel gear 168 arranged to be in engagement with bevel gear 160. Shaft 162 also carries two miter gears 170 and 172, these being arranged to be in engagement with miter gears 124' and 124 respectively. Also situated on base plate 10 underneath presser member 24 is an arrangement whereby the bottle is raised at least partially from the plate conveyor and this arrangement will be described in detail with specific reference mainly to FIG. 4.

Figure 4:
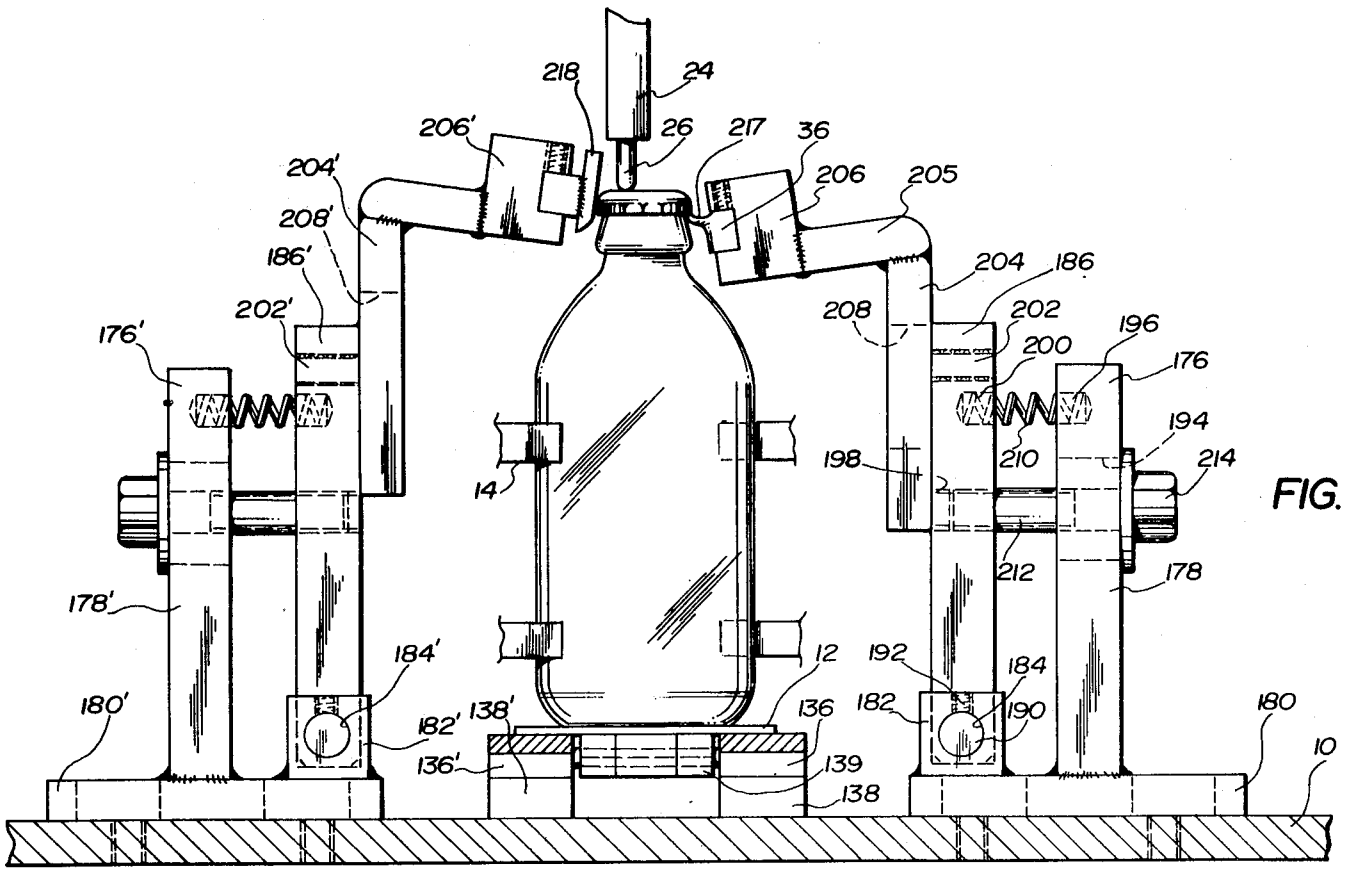
FIG. 4 is a partial end elevational view of the decapping station shown in FIGS. 1 and 2.

In FIG. 4 there is shown part of base plate 10 and plate conveyor support rails 136 and 138. A cross section of the plate conveyor 12 is shown and part of the drive mechanism therefor is 139. Located one on each side of the bottle pathway 14 and on plate 10 are brackets 176 comprising an upstanding portion 178 affixed to plate 180 which is bolted to base plate 10, and two pairs of hinge pin retaining members 182 (only one per pair visible), these members being spaced apart so as to receive therebetween a pivotable plate member 186. Each of members 182 and 186 are provided with a coincident aperture 184 through which a pin 190 is located so as to allow plate 186 to rotate about pin 190. Located through each member 182 is a screw 192 which is able to lock pin 190 into position. Extending through member 178 is a vertically oriented slot 194 and a blind bore 196, both the slot and the bore being centrally located on member 178. Plate 186, which as previously stated is pivotably mounted in bracket 176, is provided with a through bore 198 corresponding to slot 194 in member 178 and a blind bore 200 corresponding to blind bore 196 in member 178. Each plate 186 is adapted by way of screws 202 to carry a holder member 205 comprising plate portion 204 and jaw member 206. Plate member 204 is provided with two vertically oriented slots 208 to enable the holder member 205 to be secured to plate member 186 in a variety of vertically adjustable positions. The unit comprising plate 186 and affixed holder member 205 are biased away from fixed bracket 176 by way of tension spring 210. Relative movement of plate 186 and fixed bracket 176 is governed by guide shaft 212 slideably located within bore 198 and within slot 194, the shaft being maintained in position by locking arrangement 214. In this way the ambit of movement of plate 186 away from fixed bracket member 178 is restricted whilst allowing for a restricted oscillationary movement in a vertical plane. The two jaw members 206 and 206' are arranged in opposing relationship across the bottle pathway, member 206 being fitted with edge tool 36 and holder 216' with cap pusher member 34. It will be noticed that holder member 206' has been adjusted by way of screw 202' and slot 208' to be vertically higher than member 206 from the base of the bottle pathway, i.e. plate conveyor 12.

The height at which the tools 34 and 36 are located above the plate conveyor 12 base of bottle pathway 14 is dictated by the height of bottle being decapped. Adjustment is made so that the leading edge of lip portion 217 of tool 36 engages under the lower extremity of the cap skirt on bottles passing along the bottle passageway 14. The leading edge of edge or lip portion 217 is in fact the lowermost point of that lip portion, which is arranged at an acute angle to the horizontal so as to present an upward incline or slope in the direction of bottle travel. Lip member 217 may, for example, be two to three inches in length. Located opposite to lip portion 217 is the flat surface presented by cap pusher member 34. This member is also biased so as to ensure that the cap skirt does not slip off lip portion 217. As previously stated, the vertical location of these tool members 34 and 36 is adjustable to take into account different heights of bottles and also, because of the spring loading of their support members, they are able to accommodate some variances in neck width of bottles, cap sizes and also to allow for bottles arriving at the station in a non-aligned manner. Also shown in this figure is presser member 24. It will be seen that the contact portion 26 of this member is arranged to be off-centre with respect to the bottle cap and this is a preferred form allowing deformation of the cap to occur more readily. It is pointed out that the arrangement shown in FIG. 4 is the situation occurring when a bottle has just arrived at the cap loosening station and immediately prior to the commencement of the pressing/cap loosening action.

Whilst the device as shown allows for variations in bottle height etc. it will be appreciated that in some instances, for example, if a user deals with only one bottle size, such flexibility may not be required. In such circumstances, plate member 186 may be rigidly affixed to bracket 176 by bolting or welding. Alternatively, member 186 may be rigidly bolted to member 180. Similarily, member 186' may be rigidly affixed to member 180'. Obviously, care must be exercised to ensure that the lateral spacing between members 218 and 217 and the height thereof above the plate conveyor is correct. Also, in the specific embodiment described above, the required vertical movement of the bottle is obtained by arranging for the cap to ride up the inclined edge means. However, the only requirement is that the bottles are allowed to move downwardly at the cap loosening station so as to be displaced out of the cap. Such vertical displacement may be provided for in several ways. For example, in an alternative embodiment, the edge means is located substantially horizontally and the supports for the plate conveyor in the region directly below the edge means are sprung thereby allowing displacement thereof in a vertical plane. In operation, as the cap skirt is engaged over the edge means and the presser acts on the cap dome, the bottle is smoothly pressed out of the cap and is able to move downwards by depressing the underlying section of the plate conveyor. The same effect may be achieved by suitable adjustment of the spacing between the conveyor supports in the same region. In this way the conveyor is able to "sag" and thereby provide the required vertical movement for the bottle.

A further alternative is to arrange for the plate conveyor to run downwardly at an angle in the region below the edge means by suitable arrangement of the conveyor supports, such adjustments being known to one skilled in the art. When such arrangements are selected, it will be evident that the bottles need not break contact with the plate conveyor, i.e. their weight is supported by the conveyor throughout the operation. This may be advantageous in certain circumstances, for example, when very heavy bottles are being treated.

Figure 5:
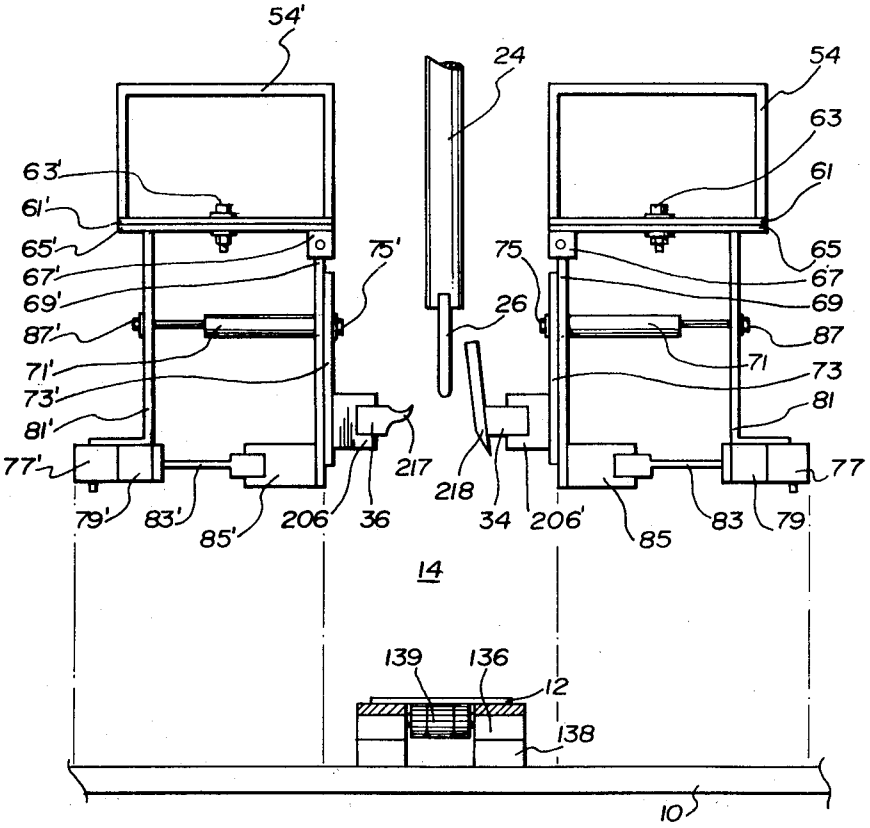
FIG. 5 is a partial end elevational view of an alternative arrangement of the decapping station shown in FIG. 4.

An alternative arrangement for supporting the tool members 34 and 36 is shown in FIG. 5, which is a partial end elevation of the decapping zone similar to that shown in FIG. 4.

As seen in FIG. 5, positioned one on each side of and above the bottle pathway 14 is the horizontal frame member 54. Fixed to the underneath of the inverted U-shaped frame member 54 is base plate 61, which is provided with a centrally located slot oriented so that its longitudinal axis is perpendicular to the bottle pathway 14. Support plate 65 is bolted to base plate 61 via bolt 63 which passes through the slot of plate 61, so that the position of plate 65 may be varied along a horizontal axis perpendicular to bottle travel. Affixed to support plate 65 near the end proximal to bottle pathway 14 is a pair of hinge pin support members 67 (only one is shown) which serve to maintain therebetween a pivotable plate member 69 having an aperture near its centre. Screw receiving member 71, provided with a threaded through-bore along its longitudinal axis, is fixed to plate member 69 so that the fixed end of said receiving member is coincident with the aperture of plate member 69. Tool member support plate 73, having a centrally located vertically oriented slot, is bolted to plate member 69 by bolt 75, which in combination with said slot allows the vertical position of plate 73 to be varied. Fixed near the lower extremity of plate 73 is jam member 206' which supports tool member 34 including cap pusher tool 218.

An air cylinder 77 is attached via bracket 79 to air cylinder support member 81 fixed to support plate 65, said member 81 being provided with a vertically oriented slot. Pivotable plate member 69 is biased away from the fixed air cylinder support member 81 by means of air cylinder 77, whose piston 83 acts on piston receiving member 85 fixed to plate member 69. The relative movement of plate 69 and air cylinder support member 81 is governed by adjustable guide screw 87 which passes through the slot in support member 81 and is located within the threaded bore of screw receiving member 71.

In this arrangement, the horizontal position of tool member 218 may be adjusted as desired by way of bolt 63 and air cylinder 77 acting in combination with guide screw 87. The vertical position of tool member 218 may be altered as desired by means of bolt 75. It will be obvious from the figure that tool member 36 is supported in an exactly identical manner as tool member 34, as shown by the numbering of corresponding support structures, and, therefore, this description applies equally thereto. Furthermore, the structure of conveyor 12 and associated elements is as described hereinbefore. Tool members 34 and 36 shown on opposite sides of bottle pathway 14 compared to FIG. 4 and it will be appreciated that this is merely to indicate interchangeability of said members without affecting the efficiency of the operation.

In certain situations supporting the tool members 34 and 36 as shown in FIG. 5 may be advantageous, for example, when the thickness or quality of the glass comprising the bottle used renders same to be exceptionally fragile. The advantage in using the present embodiment in such a circumstance is that in operation any movement of tool members 34 and 36 which might be initiated by the smooth pressing action of the presser means 24 will be translated into a slight down and outward movement. If this does occur, the slight downward movement is directed away from the fragile bottle neck thereby reducing any tendency for the bottle to be damaged.

Figure 6:
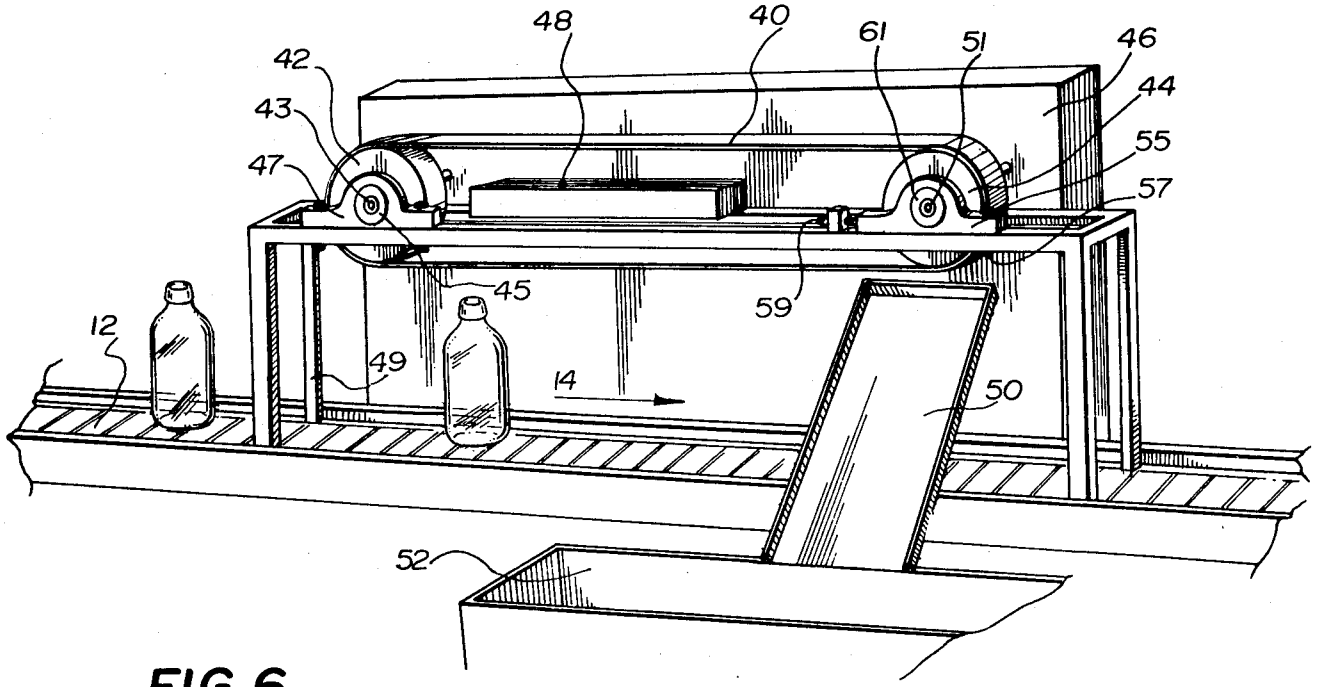
FIG. 6 is a diagrammatic perspective view of the cap removing zone shown in FIG. 1.

Turning now to FIG. 6, this is a detailed side elevational view of cap removing zone 18 which includes a magnetic cap removing and disposal device. This device includes an endless belt conveyor 40 carried by drive wheel 42 and idler wheel 44. Wheel 42 is driven via shaft 43 by an electric motor (not shown) contained in housing 46. Drive shaft 43 is journaled in bearings 45 carried by mount 47 bolted to support frame 49. Idler wheel 44 is supported in a similar manner to drive wheel 42 via non-driven shaft 51, bearing 61 and mount 55. Mount 55 is bolted to frame 49 via bolt 57 which, in combination with set screw 59, allows the longitudinal distance between parallel shafts 43 and 51 to be varied thereby altering the tension in belt 40. It should also be noted that shafts 43 and 51 are arranged at different heights above the plate conveyor 12 thus causing the lower run of belt 40 to be angled upwardly in the direction of bottle travel. This ensures that there is a relatively large separation between the top of the bottles and the end portion of the belt 40 sufficient to allow chute 50 to be positioned across the bottle pathway below belt 40 but clear of bottles travelling on the pathway. A flat bar magnet 48 is located between the runs of belt 40 and adjacent driven wheel 42: it should be noted that the magnet does not extend to idler wheel 44, but terminates a calculated distance therefrom.

Figure 7:
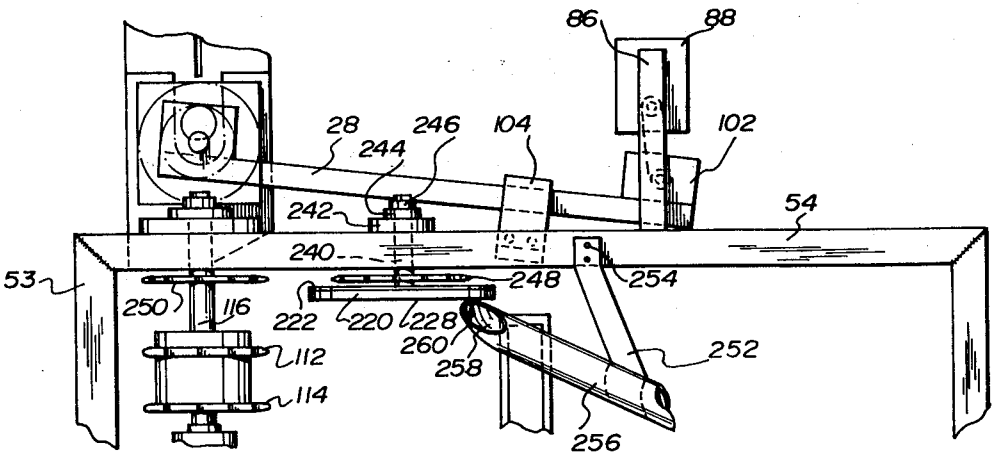
FIG. 7 is a partial side elevational view of decapping station shown in FIG. 2 incorporating an alternative cap removing zone.

An alternative means for the controlled removal and disposal of the disengaged cap is illustrated in FIG. 7, which is a partial side view of the apparatus similar to that shown in FIG. 2. This alternative device consists of a horizontally rotatable, cylindrical disc 220 provided with a top 222 to which the disc 220 is removably affixed.

Figure 8:
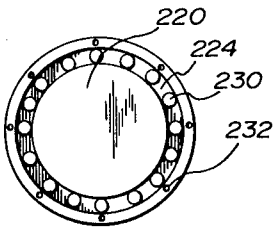
FIG. 8 is an enlarged top plan view of the disc of the alternative cap removing zone shown in FIG. 7; and, FIG. 9 is a cross-sectional side elevational view of the disc of the alternative cap removing zone shown in FIG. 7.
Figure 9:
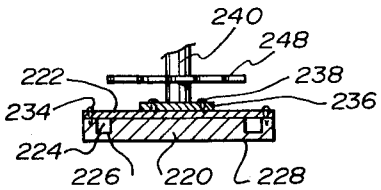

The disc 220 and associated components are shown in greater detail in FIG. 8, which is a partial, top plan view of disc 220 and FIG. 9, which is a partial cross-sectional, end elevation of the disc and associated components.

From FIGS. 8 and 9 it will be seen that disc 220 is provided with a concentric channel 224 adjacent its circumference, such that the bottom 226 of channel 224 is close and approximately parallel to the bottom surface 228 of disc 220. The channel 224 is adapted to contain a number of substantially cylindrical permanent magnets 230 spaced symmetrically within channel 224. The disc 220 is situated in the apparatus such that a portion of the channel 224 is over the midpoint of bottle pathway 14 at a position slightly higher than the disengaged cap resting on the bottle. The disc 220 is provided with a number of evenly spaced, threaded, screw holes 232 located between channel 224 and the circumference of disc 220. The top 222 is supplied with holes corresponding to screw holes 232 allowing disc 220 to be affixed to top 222 via screws 234. The top 222 is affixed in turn to plate 236 by screws 238. The central portion of plate 236 is rigidly connected to an end of a shaft 240, which is journaled in base plate 242, resting on the top of frame member 54, and held in bearing 244. The shaft 240 is maintained in position by means of collar 246. Located near the lower extremity of shaft 240 adjacent and parallel to disc 220 is an idler sprocket 248 connected by an endless chain loop (not shown) to a sprocket 250 driven via shaft 116. A support bracket 252 is affixed near its upper extremity to frame member 54 by way of bolts 254. The bracket 252 is positioned so that its lower extremity is below the level of disc 220 and is adapted to support a tube chute 256 affixed thereto. The tube chute 256 is cut diagonally across its upper extremity to provide an elliptical orifice 258. The tube chute 256 is positioned so that a lip portion 260 of the orifice 258 is situated under and adjacent the edge of bottom surface 228 of cylinder 220.

In operation, disc 220 is rotated in the direction of bottle travel by idler sprocket 248 actuated by sprocket 250 driven via shaft 116. As the bottles carrying the disengaged caps pass under disc 220, the magnets 230 within channel 224 attract the caps to and hold them against bottom surface 228 of said disc 220. As disc 220 continues to rotate the removed caps are transported away from bottle pathway 14 to tube chute 256, where the caps come in contact with lip portion 260 and are thereby dislodged from the bottom surface 228. On removal of the caps from the bottom surface 228 of disc 220, the caps fall under the influence of gravity into orifice 258 and are carried to a receptacle (not shown) by the downwardly sloping tube chute 256.

A further alternative arrangement for the removal and controlled disposal of the disengaged cap includes an air-jet positioned adjacent conveyor 12, the nozzle of said air-jet being directed across the bottle pathway 14, so that in operation said jet removes the loosened cap and directs same towards the opposite side of the bottle pathway and into a cooperating chute or receptacle.

The decapped bottles are usually passed to an emptying device wherein the bottles are inverted over a liquid collection tank for a period sufficient to allow all the bottle contents to exit the bottle. It has been found that such devices, with minor alterations, can act as the controlled cap removing station of the present invention. In particular, one bottle emptying device comprises a worm conveyor and associated bottle guides. The bottle guides are initially horizontally oriented and engage the bottle neck when vertically oriented. The guides, which are parallel, then bend to one side and downward of the worm conveyor. The bottles are thereby forced to tip over and eventually take up a position wherein the contents are able to freely exit the bottle. The bottles in this position do not fall off the conveyor since the guides are not spaced apart sufficiently for the bottle shoulder to pass therethrough. The guides maintain the bottle in the discharge position until empty and then are arranged to bend upwards so as to return the bottles to their original vertical orientation. A tank to receive the beverage is arranged underneath the appropriate section of the screw conveyor. It will be appreciated that as the bottle is slowly tipped over, the freed cap will fall off the bottle mouth at a set location and, if allowed, will fall into the underlying tank. Therefore, controlled collection of the freed caps may conveniently be effected by providing a suitable receptacle such as a wire mesh screen at the location where the freed caps fall, the the screen retaining the caps whilst the beverage passes through to the waiting tank. Alternatively, it has been found convenient to include a wire mesh filter member at the outlet of the tank itself, the accrued caps being removed periodically. Such a combined, controlled cap collection/bottling emptying station may prove advantageous, for example, when space is at a high premium.

In operation the motor 64 is started, the motor driving directly via sprockets 66 and 78, camshaft 28 whereupon presser tool member 26 commences its periodic eliptical movement, shown in phantom on FIG. 3, and simultaneously via the gear system utilizing gear members 82, 150, 160, 168, 170 and 172 and 124, sprockets 112, 114 and 112" and 114" are driven to commence movement of all four chain loops in cap loosening zone 16.

Prior to processing bottles through the device, the vertical location of tools 34 and 36 is adjusted to provide for the type of bottle to be decapped.

Bottles are then introduced onto plate conveyor 12, for example, from a carton emptying device (not shown) and bottles are introduced individually to the cap loosening station. At the station an edge of each cap is retained upon the lower portion of edge member 36 whilst the opposing edge is restrained from moving laterally by cap pusher member 34. Throughout passage through the cap loosening zone 16 each bottle is moved continuously by plate conveyor 12 or the projections 22 on the chain loop system 20. Therefore, upon the lower edge of the skirt becoming engaged over lip portion 217 and being prevented from slipping therefrom, the cap automatically rides up the incline presented by lip portion 217 and, since at this point it is still affixed to the bottle, the bottle is raised at least partially from plate conveyor 12. As soon as the bottle commences to separate from the conveyor 12 presser tool 26 is arranged to contact and press smoothly down thereon during passage of the cap along lip portion 217. The result is that the cap skirt is deformed to an extent that the cap is totally freed from the sealing ring on the bottle neck. However, the presser tool 26 is maintained in contact with the cap substantially until the bottle returns to be seated on plate conveyor 12 thus ensuring that the cap, although totally freed from engagement with the bottle sealing ring, is left astride the mouth of the bottle. Upon being reseated on plate conveyor 12 the bottle carrying the freed cap is carried out of zone 16 and on to zone 18. In zone 18, each bottle passes directly underneath continuous belt 40 whereupon the bottle cap "jumps" upwardly to become lodged against the lower run of belt 40 under the attraction of magnet 48 and remains abutting said belt until it reaches the region overlying chute 50 whereupon the magnetic attraction is reduced to an extent wherein the cap is no longer held against said belt whereupon it simply falls under gravity onto chute 50 and finally comes to rest in receptacle 52. The bottle exits zone 18 still on plate conveyor 12 to a further device (not shown) whereupon it is automatically inverted and thereby emptied or wherein it is manually emptied.

What is claimed is:

1. An apparatus for decapping of filled bottles comprising a decapping station, conveyor means for transporting vertically oriented filled bottles, sealed with a crown cap having a dome and skirt, to said station, means defining at least one edge engageable under a lower extremity of the skirt so as to be able to support the associated bottle whilst the bottle is travelling through said station; a chisel-like presser means at said station adapted to move in an elliptical path in a vertical plane above and in the direction of, and substantially synchronous with, bottle travel, whereby the presser means smoothly presses down on the cap dome during travel along the lower limb of the eliptical path whilst the bottle is supported by said edge means, the presser means and edge means combining to deform the cap in such a manner that the skirt portion thereof disengages the bottle neck, and means adapted to controllably remove the freed cap overlying the bottle mouth.

2. The apparatus of claim 1 wherein the means defining at least one edge engageable under a lower extremity of the skirt is an elongated lip and the axis of the lip and conveyor means diverge in the direction of bottle travel.

3. The apparatus of claim 1 wherein additional conveyor means are provided to urge bottles through said decapping station when said bottles are at least partially separated from the conveyor means.

4. The apparatus of claim 1 wherein said chisel-like presser means is arranged to press down on the cap dome laterally of the central axis of the bottle.

5. The apparatus of claim 1 wherein cap pusher means is arranged diammetrically opposing the edge means so as to urge and maintain the skirt extremity in engagement with the lip member.

6. The apparatus of claim 1 wherein the means adapted to controllably remove the freed cap in a magnetic device arranged above the bottle pathway.

* * * * *